US008141314B2

(12) United States Patent
Rosan

(10) Patent No.: US 8,141,314 B2
(45) Date of Patent: Mar. 27, 2012

(54) EXPANSION JOINT FOR MODULAR FLOORING SYSTEM

(75) Inventor: Arnon Rosan, New York, NY (US)

(73) Assignee: Signature Fencing and Flooring Systems, Inc., New York, NY (US)

( * ) Notice: Subject to any disclaimer, the term of this patent is extended or adjusted under 35 U.S.C. 154(b) by 239 days.

(21) Appl. No.: 12/471,956

(22) Filed: May 26, 2009

(65) Prior Publication Data

US 2010/0300023 A1 Dec. 2, 2010

(51) Int. Cl.
*E04B 2/08* (2006.01)

(52) U.S. Cl. ..... 52/589.1; 52/395; 52/402; 52/591.5

(58) Field of Classification Search ..... 52/394, 52/395, 402, 582.1, 591.5, 581, 591.1, 589.1, 52/591.3, 592.1, 592.2, 588.1, 582.2, 302.1, 52/302.4

See application file for complete search history.

(56) References Cited

U.S. PATENT DOCUMENTS

| | | | | |
|---|---|---|---|---|
| 1,977,496 | A | 10/1934 | Snyder et al. | |
| 4,198,795 | A | 4/1980 | Barnidge | |
| 4,436,779 | A | 3/1984 | Menconi et al. | |
| 5,295,341 | A * | 3/1994 | Kajiwara | 52/586.2 |
| 5,403,063 | A | 4/1995 | Sjostedt et al. | |
| 5,427,558 | A | 6/1995 | Kundsen et al. | |
| 5,469,999 | A | 11/1995 | Phirippidis | |
| 5,509,244 | A * | 4/1996 | Bentzon | 52/387 |
| 6,094,882 | A * | 8/2000 | Pervan | 52/745.19 |
| 6,220,785 | B1 | 4/2001 | Kennedy et al. | |
| 6,434,897 | B1 * | 8/2002 | Sievers et al. | 52/177 |
| 6,564,522 | B1 | 5/2003 | Chiu-Ying | |
| 6,751,912 | B2 * | 6/2004 | Stegner et al. | 52/177 |
| 7,080,491 | B1 * | 7/2006 | Shreiner et al. | 52/393 |
| 7,340,865 | B2 * | 3/2008 | Vanderhoef | 52/177 |
| 7,516,587 | B2 * | 4/2009 | Barlow | 52/591.2 |
| 7,827,750 | B2 * | 11/2010 | Sondermann | 52/396.04 |
| 2002/0059764 | A1 | 5/2002 | Schluter | |
| 2003/0093964 | A1 * | 5/2003 | Bushey et al. | 52/592.1 |
| 2004/0216250 | A1 | 11/2004 | Dumlao et al. | |
| 2004/0258869 | A1 | 12/2004 | Walker | |
| 2008/0127593 | A1 | 6/2008 | Janesky | |
| 2009/0133349 | A1 * | 5/2009 | Sondermann | 52/395 |
| 2009/0217611 | A1 * | 9/2009 | Schrader | 52/394 |

FOREIGN PATENT DOCUMENTS

DE 3445071 A1 * 6/1986

* cited by examiner

*Primary Examiner* — William Gilbert
*Assistant Examiner* — Beth Stephan
(74) *Attorney, Agent, or Firm* — Metz Lewis Brodman Must O'Keefe LLC; Barry I. Friedman

(57) ABSTRACT

An expansion joint for a modular flooring system in disclosed, which includes the slidable engagement of two subsections of the expansion joint. The expansion joint is sized such that it is equivalent in overall dimension to the intended adjacent modular floor tiles of which it will form a part within a matrix of such interlocked modular floor tiles. The expansion joint is provided with at least one slot on one module, corresponding to at least one locking pin on the other module. The slot receives and restrains the locking pin and permits the slidable engagement along the longitudinal axes thereof.

20 Claims, 8 Drawing Sheets

EXPANSION JOINT FOR MODULAR FLOORING SYSTEM

BACKGROUND OF THE INVENTION

1. Field of the Invention

The invention relates to an expansion joint for modular flooring. More particularly, the invention relates to the use of a slidable member which is interspersed between tiles of plastic modular flooring, which is adapted to permit relative movement of subsections of the modular flooring during installation.

2. Description of the Prior Art

Modular flooring of various designs has been utilized for a significant period of time to provide a temporary walking or other rigid surface in areas where permanent flooring is either not necessary or prohibitively expensive. More particularly, modular flooring is primarily utilized in commercial settings where a floor is temporarily needed, such as on a grass or artificial turf surface as well as in industrial or construction areas. With respect to industrial or construction areas, temporary flooring may be utilized to provide walkways, driveways, parking areas or other rigid surfaces for the transport of materials, vehicles, storage or mounting of equipment, or simply as a walking or standing surface for people. The modular nature of such flooring is utilized to adapt the flooring to the particular topographic or geographic needs of the particular site and to also allow for the efficient storage and transport of the modular flooring. In addition, the use of relatively small modular floor tiles permits repairs and disposal of broken floor sections with relative ease.

In operation, the selection of the particular floor tile and its characteristics are primarily based upon the amount of load expected to be exerted on the modular flooring system, as well as the relative support characteristics of the underlying substrate be it concrete, artificial turf, grass, dirt, or the like. Once the particular floor tile is selected, a number of modular tiles typically having some type of interlock mechanism are applied to the surface and are generally laid in a sequential pattern, permitting the selective interlock of the various tiles and the placement of those tiles in a preplanned topographic design intended to permit the movement of materials, people, vehicles or the storage of the same in appropriate locations. The modular floor tiles are themselves typically constructed of plastic or other polymeric materials which permit relatively high-strength sections having relatively low weight, providing ease of storage and portability. One particular shortcoming of plastic and polymeric materials is the coefficient of thermal expansion, which is relatively high in practice. Changes in temperature of the underlying substrate material, as well as the ambient air proximate to the modular floor system cause relatively significant changes in dimensionality of the floor tiles. While the dimensional changes in each individual tile are relatively small, over a large area with hundreds, perhaps thousands, of interlocked tiles, the cumulative expansion or contraction of the entire flooring system causes significant problems with respect to maintenance of the floor, as well as the safety of the users.

In practice, this expansion of the modular flooring system causes buckling, shifting and cracking of the floor tiles, as well as providing a tripping hazard for persons walking on the floor and potentially causing dangerous conditions which could cause vehicles to be diverted from their intended course over the surface of the modular floor.

Other limitations of the modular flooring system include the requirement that the floor be laid sequentially in order to ensure the appropriate alignment and interlocking of the modular tiles. In practice, this means that a tile floor must be laid from one location and expanding outwardly from that location on an interlocking basis and cannot be laid in discontinuance sections. Furthermore, the alignment and location of each tile is very important because small deviations from the preplanned alignment of the tiles over the course of longer distances will result in a floor being significantly displaced from its preplanned location. This results in significant delays and costs associated with picking up and relaying the various floor tiles once the misalignment has been discovery after a significant number of tiles have been laid.

There remains a need, therefore, in the art of modular flooring, for an adjustable or displaceable tile which may be inserted at various locations in a modular floor system to absorb the expansion of the floor tiles in atmospheric conditions which cause expansion and contraction of the modular floor or subsections thereof. Additionally, there remains a need in the art for an adjustable tile which may be inserted in order to maintain the alignment and appropriate location of sections for the entirety of the modular floor over its length.

SUMMARY OF THE INVENTION

A modular floor expansion joint is disclosed which provides both a means for absorbing the expansion of adjoining floor tiles and permitting the various expanding or contracting sections of the modular floor to remain flat on the substrate, as well as to permit a minimal amount of misalignment in the application of the floor tiles to a substrate by providing an adjustment means for subsections of the floor. In practice, this permits the insertion of the expansion joint tiles at locations where a misalignment has occurred and been discovered. Once a significant portion of the modular floor has been laid, the adjustability of the modular floor tile expansion joint permits the realignment of neighboring sections of adjoined modular floor tiles to the preplanned topographic location. The expansion joint also prevents the floor to be laid in discontinuous sections which may be moderately misaligned and joined by the adjustable expansion tile.

The expansion joint floor tile is provided as a generally slidably, adjustable multi-section tile and is equipped with appropriately sized and shaped interlocking devices such that it may be mounted within a floor tile matrix as any location, replacing one or a series of modular floor tiles without disrupting the alignment pattern of such a modular floor tile system. The slidable multi-part tile is generally adapted to expand or contract in one dimension, but may be laid in an aligned pattern, such that the axes of expansion are aligned linearly or in a parallel fashion, or may be laid in a parquet style to permit multi-dimensional expansion or contraction of the floor as well.

The multi-section expansion joint is generally provided in the preferred embodiment with two interlocking sections, one of which slides and is located within a locating sleeve of the other. An indented or undercut portion of a first member is adapted to be inserted and be slidably displaceable within the sleeve provided in the second member. The two members are adapted to be either temporarily or permanently joined through any particular means well-known to those skilled in the art in the preferred embodiments. A protrusion is provided on one member to be interfaced with a slot on the second member, such that the protrusion may be inserted into the slot and then laterally displaced along the longitudinal axis of the slot. A variety of locating means may be utilized to both use the insertion of the members together, as well as to maintain the geometric alignment of the two members during the sliding process in an axial fashion.

In order to maintain the compressive strength of the floor tile system, a series of support webs, or other reinforcing means may be applied to the expansion joint, such that it matches the adjoining floor tiles in height and other critical dimensions, as well as its ability to support the intended load. Lastly, for both cosmetic and functional reasons, the exterior surface of the floor tile may be provided with both decorative embellishments, as well as various ventilation or other functional surface features to permit or prevent the passage of moisture facilitating the passage of persons and vehicles thereover. This is utilized to increase the frictional characteristics of the top surface so that a slippery condition is not provided on the top surface when mounted within the modular flooring system.

These and other advantages of the expansion joint provided herein will be more fully understood with reference to the appended drawings and the description of the preferred embodiments herein.

DESCRIPTION OF THE PREFERRED EMBODIMENTS

Figure 1:
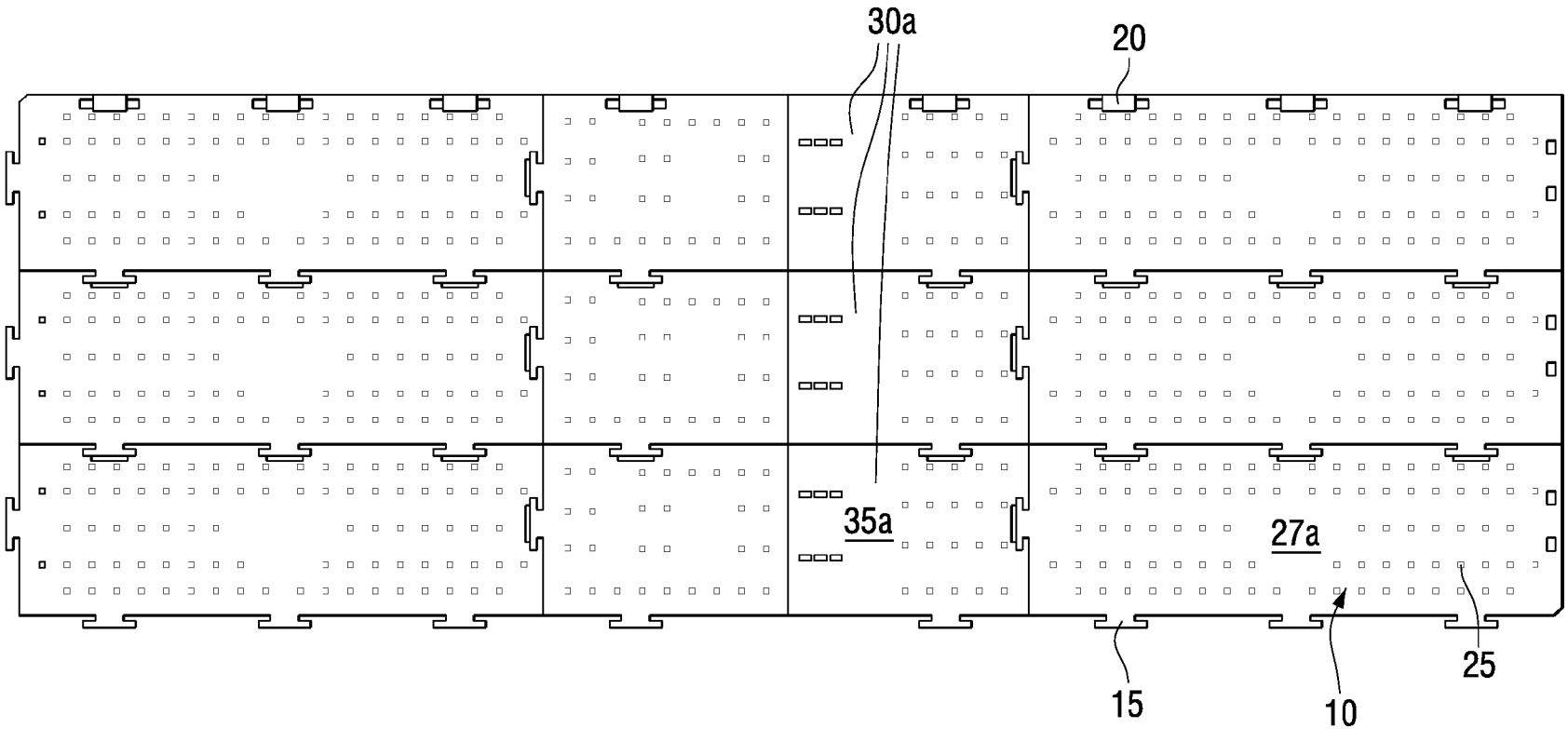
FIG. 1 is a top plan view of a first embodiment of a modular flooring system, including both prior art floor tiles and a first embodiment of the expansion joint tile.
Figure 2:
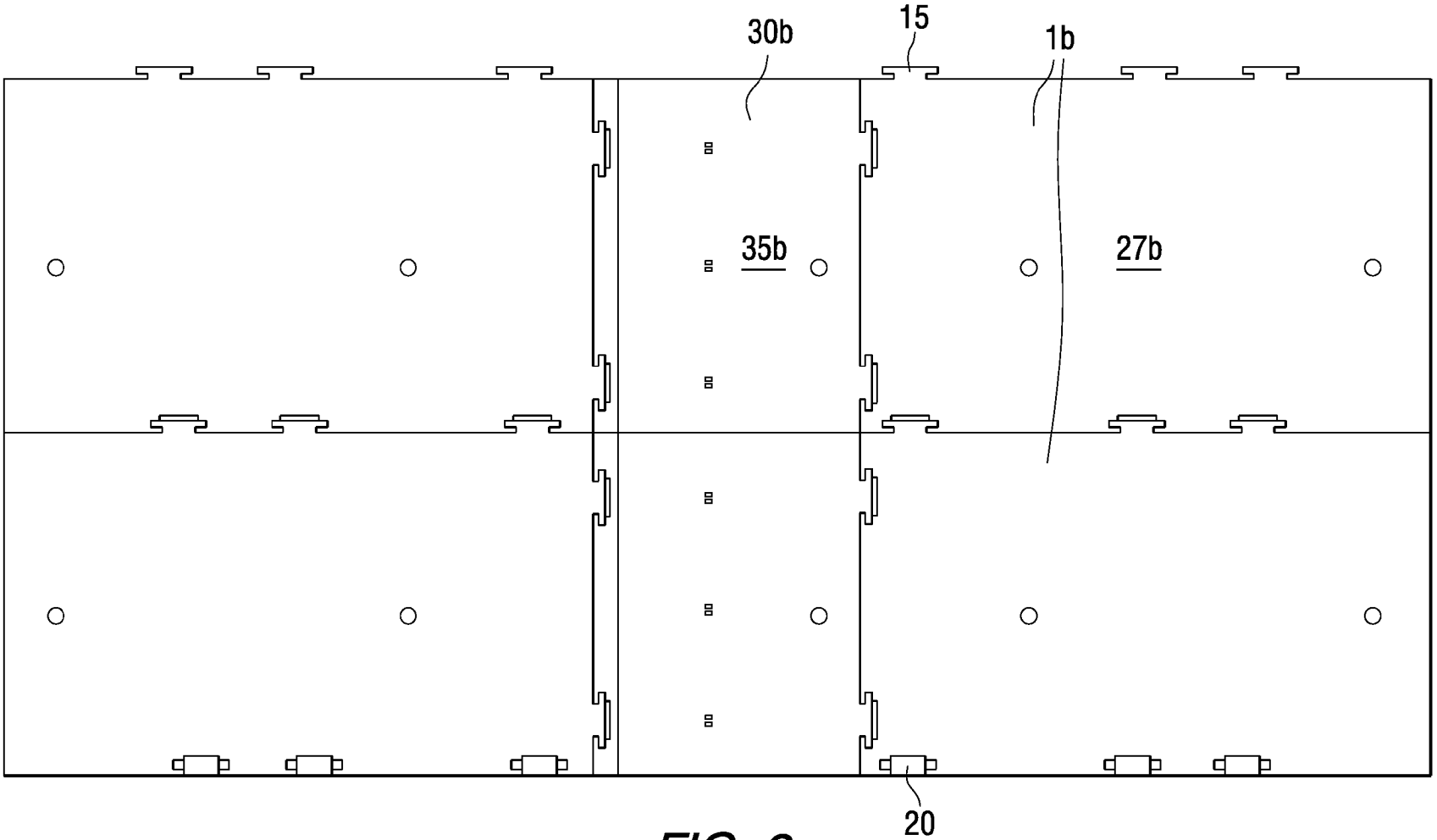
FIG. 2 is a top plan view of a second embodiment of a modular flooring system, including both prior art floor tiles and a second embodiment of the expansion joint tile.

Referring to FIG. 1, a matrix of modular floor tiles is illustrated having a number of component parts. A first embodiment is depicted in FIG. 1 while a second embodiment is depicted in FIG. 2. Referring now to FIGS. 1 and 2, modular floor tiles of the prior art are identified as floor tiles 1. The first embodiment being identified as embodiment 1*a* and the second embodiment being 1*b*. References herein to elements common to both embodiments will identify those same elements by reference numeral where the embodiments differ. The further identifiers, a and b will be used respectively, modular floor tiles 1 are provided in an interlocking matrix 10 which extends in two dimensions in accordance with a preset topographic plan. As discussed previously, the topographic plan is typically directed towards the conveyance or support of equipment, vehicles, personnel and the like and is adapted to conform to the topographic or geographic features of the substrate surface, such as grass, dirt, artificial turf or the like, modular floor tiles 1 are typically constructed of plastic material and are preferably polypropylene, polyethylene, polystyrene, acrylonitrile butadiene styrene, and polyvinylchloride. Differences between the first and second embodiments, as well as other embodiments not illustrated herein, but within the scope of knowledge of one skilled in the art, would include changes in dimensionality, including height, width and length, as well as surface features. Although not specifically illustrated, the invention contemplates the use of three-dimensional surface features to reduce slippage as well as ventilation holes 25 illustrated in FIG. 1 of the first embodiment. Other applications may include three-dimensional surface features for the conveyance of moisture, as well as for decorative purposes. One significant feature of modular floor tile 1 when assembled into a matrix 10 is the desire to reduce any misalignment or unintentional three-dimensional surface changes in the top surface 27 of the floor tiles. Any height misalignment or departure of the floor tile from uniform engagement with the substrate may result in an unsafe condition presented by improper interlocking of modular floor tiles 1 or buckling of the entirety or portions of the matrix 10 surface causing an uneven walking or vehicular traffic surface.

In application, modular floor tiles 1 are typically provided with a series of locking tabs 15, which extend outwardly from the perimeter of each tile. In accordance with the specific design features of each embodiment, the locking tabs may be of any size or shape appropriate to support the weight and load requirements of the tile. Furthermore, the number of distribution of the locking tabs 15 are determined by the physical conditions of the likely substrate, as well as the load requirements mentioned previously. Locking receptacles 20 are also located on the perimeter of each of the modular floor tiles 1 for receiving and restraining locking tabs 15 and are disposed geometrically in accordance with the corresponding location of locking tabs 15 on adjacent floor tiles 1. It will thus be appreciated that the sequential application of modular floor tiles 1 will include the serial interlocking of adjacent floor tiles in a matter to extend matrix 10 in two dimensions. In accordance with the preferred embodiments herein, an expansion tile 30 is provided, which may be interspersed at various frequencies within matrix 10 as a substitute for modular floor tiles 1. Expansion tiles 30 may be aligned linearly on an axial geometry or as illustrated in FIGS. 1 and 2. The linear geometry in which the adjacent expansion tiles 30 are adapted and aligned, such that the direction of their expandability is similarly aligned to provide an extended section of expandability within matrix 10, as will be more fully understood with references to FIGS. 3 and 4. As illustrated in FIGS. 1 and 2, expansion tiles 30 are shown in a closed position, which is one of three likely positions provided for expansion tiles 30 being fully closed, fully open and then intermediate position. The mounting and insertion of expansion tiles 30 is dependent upon the anticipated changes in weather conditions, as well as changes in substrate and the likely need for adapting matrix 10 during the installation period of modular floor tiles 1. It will be appreciated by those skilled in the art that to the extent that the likely temperature change of the ambient air and adjacent surface or substrate is likely to increase then the expansion tile 30 would be laid in an open position or an intermediate position whereas, if it is likely that the temperature will substantially decrease, then the expansion tile 30 would be laid in the closed position, or an intermediate position, as it is well-known to those skilled in the art that the plastic material expands with increasing temperature. The insertion of expansion tiles 30 are specifically intended to permit the relative movement of sections of matrix 10 relative to each other during the expansion and contraction of modular floor tiles 1 within matrix 10, without creating any surface irregularities or misalignments of modular floor tiles 1 within matrix 10. Furthermore, it is intended that the adjustability of expansion tiles 30 will reduce damage to modular floor tiles 1, which might occur as a consequence of the relative rigidity of modular floor tiles 1 within respect to the increasing or decreasing lateral forces on the tile within the matrix because of changing temperatures.

Figure 3:
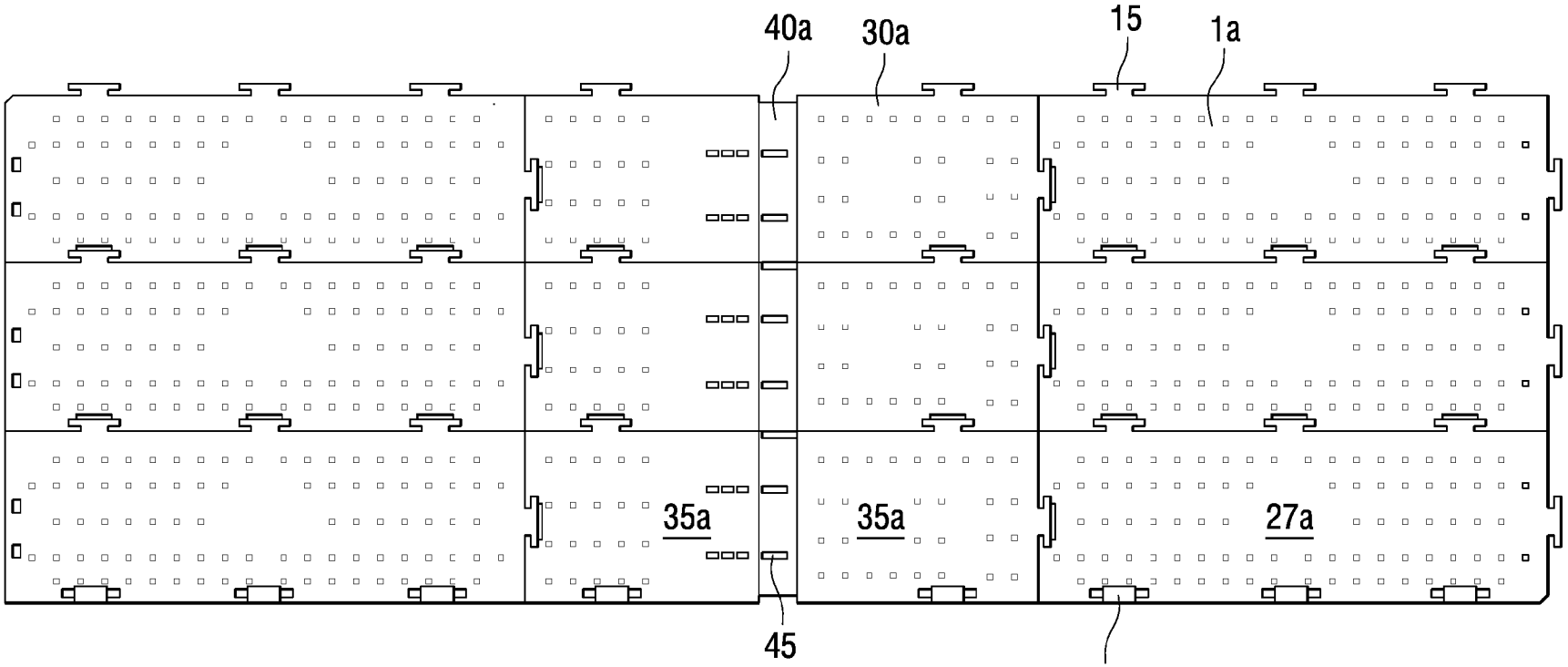
FIG. 3 is a top plan view of the embodiment illustrated in FIG. 1 with the expansion joint in an extended orientation.
Figure 4:
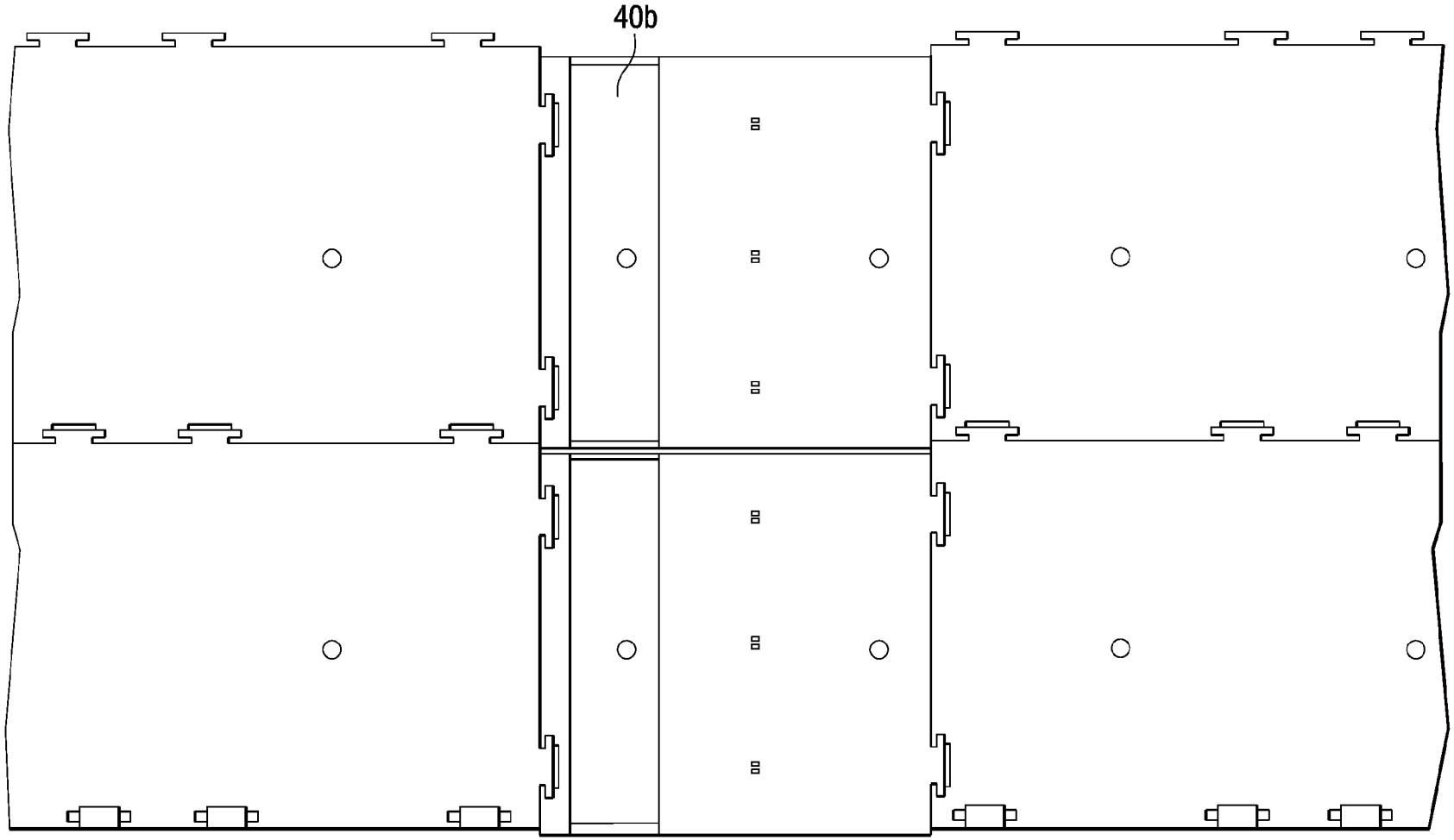
FIG. 4 is a top plan view of the embodiment illustrated in FIG. 2 with the expansion joint in an extended orientation.

Referring now to FIGS. 3 and 4, expansion tile 30 is shown in an extended orientation or open orientation which pen-nits the exposure of the interior of expansion tile 30. Expansion tile 30 is provided with a top surface 35 and the expansion joint itself is provided with expansion joint top surface 40, as will be more fully illustrated with respect to FIGS. 5, 6, 7 and 8. The design of expansion tile 30 is specifically intended to provide a relatively flat surface within the tolerances necessary to reduce any hazard of tripping or other negative consequences of an uneven floor surface. Even in the extended or open mode identified in FIGS. 3 and 4, expansion tile 30 provides a relatively flat surface over the extent of matrix 10 with significant minimization of surface irregularities or discontinuous portions.

Figure 5:
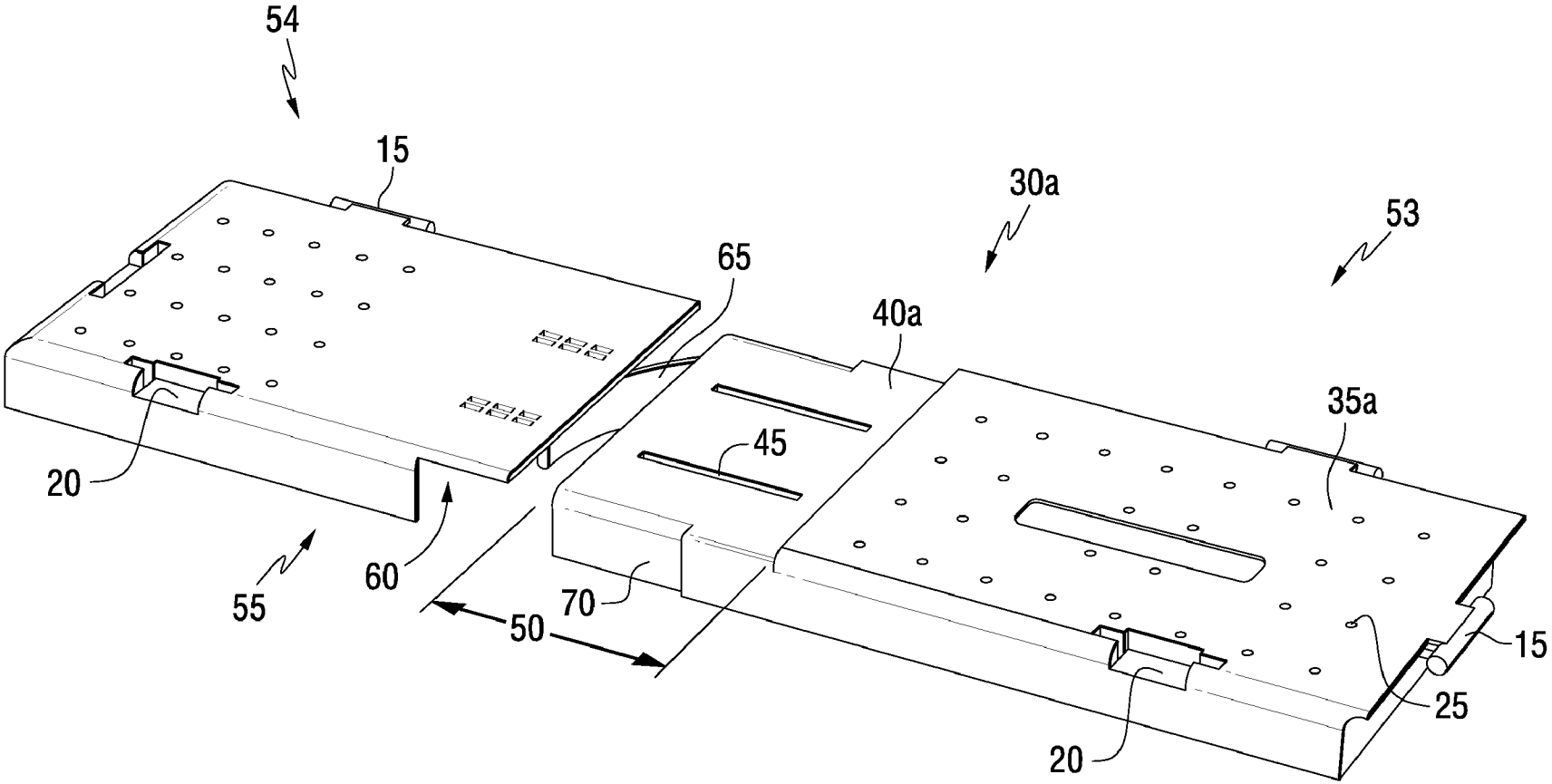
FIG. 5 is an isometric exploded view of a first embodiment of the expansion joint as seen from the top.
Figure 6:
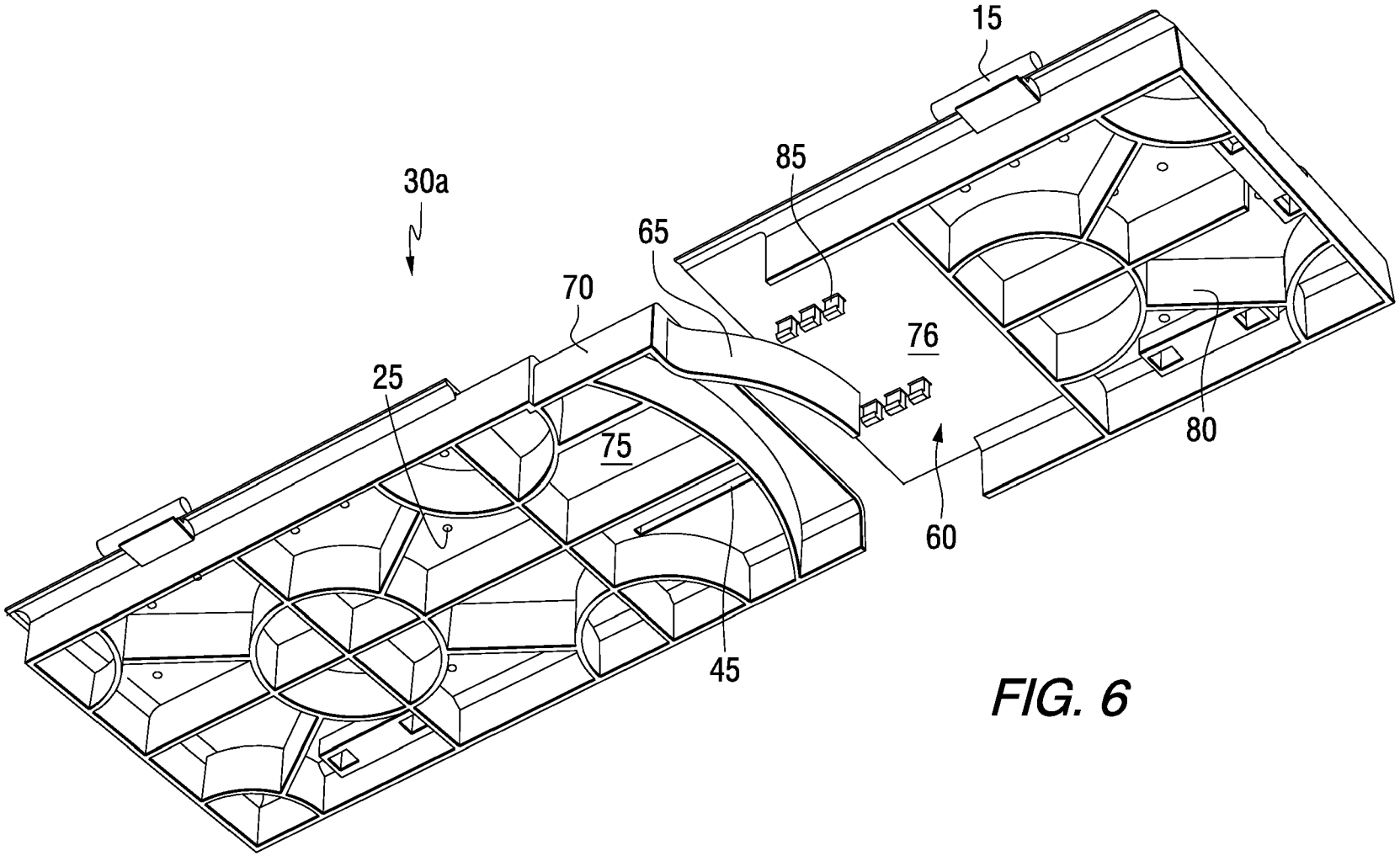
FIG. 6 is an isometric exploded view of a first embodiment of the expansion joint as seen from the bottom.

Referring now to FIGS. 5 and 6, the specific features unique to the first embodiment will be illustrated. However, unless specifically identified as a separate features, corresponding parts having identical reference numerals between the first and second embodiments illustrated in FIGS. 5 and 6, and 7 and 8, respectively, shall be considered applicable to both embodiments. Referring now particularly to FIGS. 5 and 6, expansion tile 30*a* is provided with an expansion tile upper surface 35*a*, locking tabs 15 are provided in a generally "T" shaped orientation, having a roughly cylindrical members extending outwardly therefrom for the rotational insert in corresponding locking receptacles 20, where locking tab 15 may be tipped in at an angle to the substrate surface and inserted within locking receptacle 20 and rotated angularly about locking tab 15 to permit the secure interconnection between adjacent expansion tiles 30 or separate ones of expansion tiles 30 and modular floor tiles 1.

Expansion tile 30*a* is generally provided with two separable subsections, being the support section 53 and the sleeve section 54. In general operations, support section 53 is inserted into and slidably engages sleeve section 54. Support section 53 is provided with an expansion joint support 50 in the general format of an extending armature which is partially defined by undercut track 70 and expansion joint top surface 40*a*. The combination of these two elements form expansion joint support 50, which is an adaption for slidable engagement and insertion into sleeve section 54. Expansion joint support 50 is provided with expansion slots 45 on expansion joint top surface thereof, which are adapted to receive and slidably restrain locking pins 85, as will be further discussed with respect to FIG. 6. A flexible spring 65 is provided at the distal end of expansion joint support 50 for engagement with an inner surface of sleeve section 54 and which biases expansion tile 30*a* from a closed position to an intermediate open position.

Sleeve section 54 is provided with expansion joint sleeve 55, which is defined as an overhanging section of sleeve section 54, adapted to receive expansion joint support 50 within expansion joint receiver 60, defining an open space into which expansion joint support 50 is inserted and received. Essentially, expansion joint receiver 60 is formed by an overhanging section of expansion tile top surface 35*a* and the side walls of sleeve section 54. Referring now to FIG. 6, the undersurface of expansion tile 30*a* is illustrated, having a series of support web members 80 which may be arranged and disposed in any particular pattern, which provides dimensional and load support for top surface 35*a*. The bottom surface 75 of expansion tile 30*a* is formed as the underside of the plastic sheeting material forming top surface 35*a* and ventilation holes 25 extend therethrough to provide fluid and/or air communication between expansion joint bottom surface 75 and top surface 35*a*. Expansion joint sleeve bottom surface 76 is provided with at least one, and preferably a series of locking pins 85, which are typically extending outwardly from expansion joint sleeve bottom surface 76 and are provided with any type of restraining geometry known to those skilled in the art and most preferably at least one hook interface to be inserted within slots 45 of support section 53 for a semi-permanent engagement. It is specifically intended that having been inserted in slots 45, locking pins 85 are either not removable or removable only with intent and some degree of difficulty. As assembled, expansion tile 35*a* permits the slidable engagement of support section 53 and sleeve section 54 through the displacement of locking pins 85 within slots 45 and the extremes of such travel are defined by the length of slot 45 and the number and location of locking pins 85.

Figure 7:
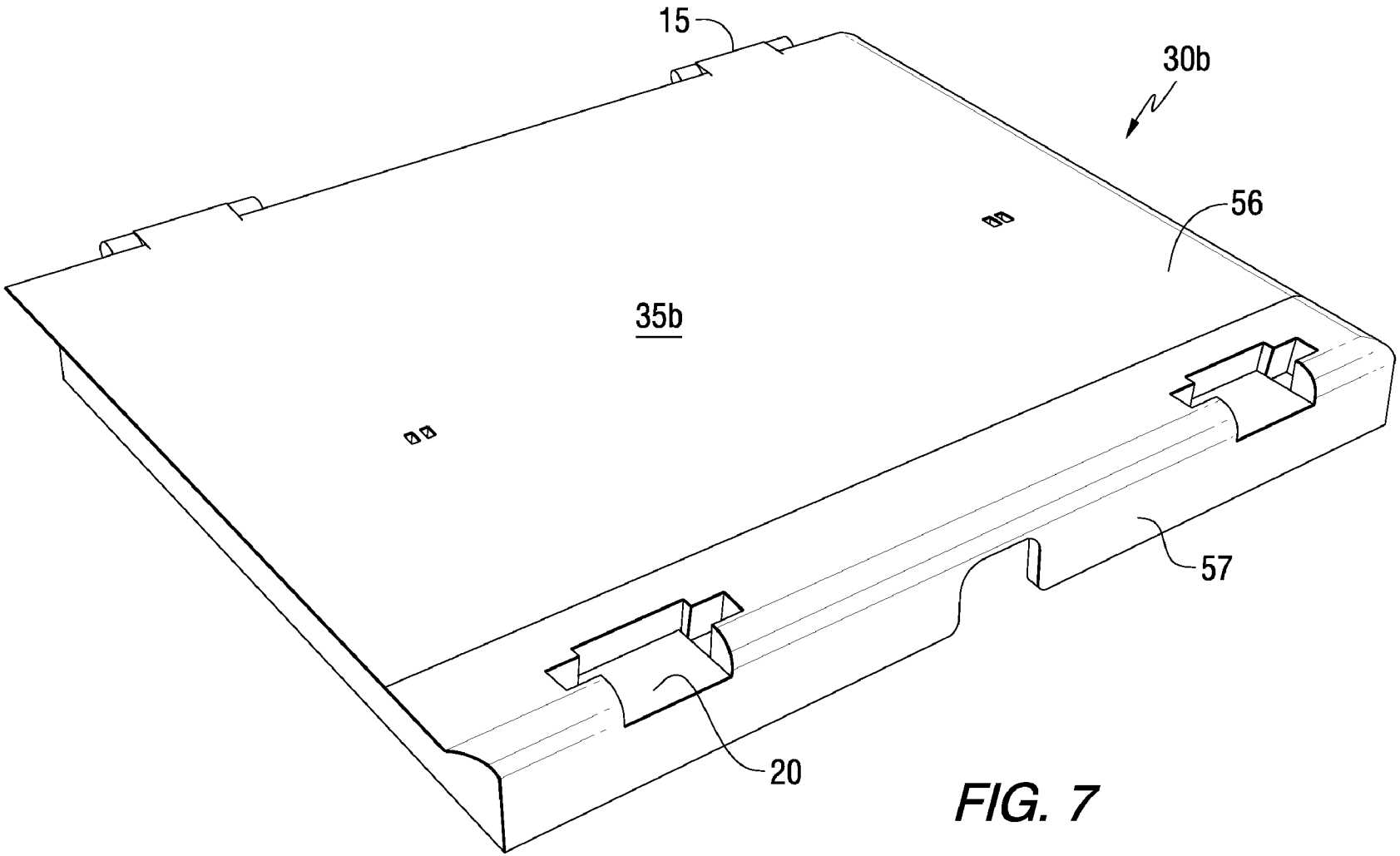
FIG. 7 is an isometric view of the top of the second embodiment of the expansion joint in the closed position.
Figure 8:
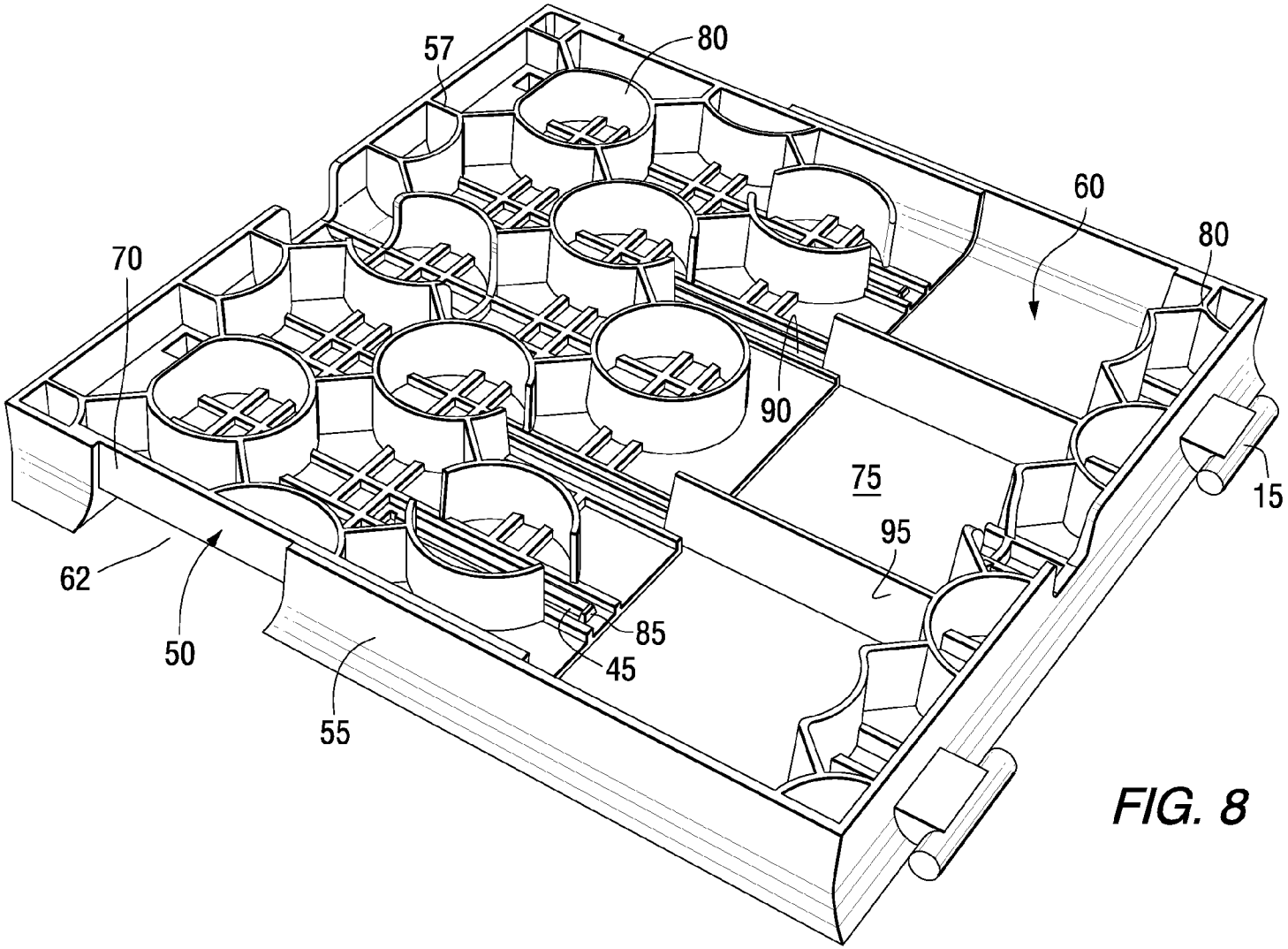
FIG. 8 is an isometric view of the second embodiment of expansion joint as viewed from the bottom in the open position.

Referring flow to FIGS. 7 and 8, the second embodiment is illustrative of expansion tile 30*b* having a top surface 35*b* and an insert section 57 and receiver section 56. While not functionally identical to support section 53 and sleeve section 54, insert section 57 and receiver section 56 perform roughly analogous functions. As with the first embodiment, expansion joint bottom surface 75 is provided with at least one or a series of support webs 80, which provides structural support for top surface 35*b*. Insert section 57 is generally provided with an expansion joint 50, which is formed primarily by undercut track 70 and is adapted to be inserted in slidably received by expansion joint receiver 60 within receiver section 56. A series of expansion slots 45 are provided for receiving and restraining locking pins 85, which are affixed to the bottom surface 75 of receiver section 56. As with the first embodiment, these locking pins may be provided with any particular arrangement of protrusions to permit the engagement and restraint of locking pins 85 within slots 45. The second embodiment, however, provides an insertion hole 62 within expansion slot 45 for the easy insertion and removal of locking pins 85 within expansion slot 45. As with the first embodiment, the locking pins 85 define the length and extent of travel of the slidable engagement between receiver section 56 and insert section 57. Additional lateral support for the sliding engagement of receiver section 56 and insert section 57 is provided by locating slots 90 provided in insert section 57 and locating tabs 95 provided on the bottom surface 75 of receiver section 56. Locating tabs 95 are arranged perpendicularly to bottom surface 75 and are adapted for the slidable insertion within locating slots 90.

Finally, one preferred embodiment of the invention has been described hereinabove and those of ordinary skill in the art will recognize that this embodiment may be modified and altered without departing from the central spirit and scope of the invention. Thus, the embodiment described hereinabove is to be considered in all respects as illustrative and not restrictive. The scope of the invention being indicated by the appended claims rather than the foregoing descriptions and all changes which come within the meaning and range of equivalency of the claims are intended to be embraced herein.

What is claimed is:

1. An expandable modular floor tile comprising:

a first floor tile subsection having a top surface; at least one leg for supporting said top surface on a substrate; a receiving sleeve and an interlock for the intermittent connection of said expandable modular floor tile with at least one other modular floor tile;

a second floor tile subsection having a top surface; at least one leg for supporting said top surface on said substrate;

a support, extending from and integral with said second floor tile subsection, having a top surface and at least one leg, wherein said top surface of said support is supported by said at least one leg on said substrate, said support being sized for slidable, removable engagement with said receiving sleeve of said first floor tile subsection and an interlock for intermittent connection of said expandable modular floor tile with at least one other modular floor tile; and a lock for the selective, slidable interconnection between said first and second floor tile subsections.

2. An expandable modular floor tile as described in claim 1, wherein said lock further comprises at least one locking pin provided extending outwardly from at least one of said first and second subsections which slidably engages and is restrained within an elongated aperture in the other of said subsections.

3. An expandable modular floor tile as described in claim 2, wherein said locking pin is provided with at least one protrusion which restrains said locking pin in said aperture.

4. An expandable modular floor tile as described in claim 2, wherein said locking pin is permanently restrained within said aperture after insertion therein.

5. An expandable modular floor tile as described in claim 2, wherein said aperture further comprises an insertion point for the insertion and removal of said locking pin.

6. An expandable modular floor tile as described in claim 1, wherein said second subsection further comprises a main body and said support extends outwardly therefrom along a longitudinal axis.

7. An expandable modular floor tile as described in claim 6, wherein said support is undercut with respect to said main body.

8. An expandable modular floor tile as described in claim 1, wherein said first subsection further comprises a main body and said receiving sleeve extends outwardly therefrom along a longitudinal axis.

9. An expandable modular floor tile as described in claim 8, wherein said receiving sleeve further comprises a three sided enclosure for receiving and slidably restraining said support.

10. An expandable modular floor tile as described in claim 1, further comprising a top surface having features for increasing the traction of said top surface.

11. An expandable modular floor tile as described in claim 1, further comprising a top surface having features for one of distribution and transmission of fluids.

12. An expandable modular floor tile as described in claim 11, wherein said top surface features are ventilation holes.

13. An expandable modular floor tile as described in claim 1, wherein said subsections may be positioned in at least one of open, closed and intermediate positions.

14. An expandable modular floor tile as described in claim 13, further comprising a top surface which is generally flat while said expandable modular floor tile is positioned in any position.

15. An expandable modular floor tile as described in claim 13, wherein said subsections are resiliently biased toward at least one of said positions.

16. An expandable modular floor tile as described in claim 1, further comprising a structural support web.

17. An expandable modular floor tile as described in claim 1, wherein said interlock facilitates at least one of the alignment and slidable displacement of said expandable floor tile.

18. An expandable modular floor tile as described in claim 1, wherein said interlock further comprises a slot and tab.

19. An expandable modular floor tile as described in claim 18, wherein said interlock slot is provided in said second subsection and said locator tab is provided on said first subsection.

20. A matrix of interlocked modular floor tiles, at least one of said modular floor tiles further comprising:

a first floor tile subsection having a top surface; at least one leg for supporting said top surface on a substrate; a receiving sleeve and an interlock for the intermittent connection of said expandable modular floor tile with at least other modular floor tile;

a second floor tile subsection having a top surface; at least one leg for supporting said top surface on said substrate;

a support sized for slidable, removable engagement with said receiving sleeve of said first floor tile subsection extending from and integral with said second floor tile subsection, having a top surface and at least one leg, wherein said top surface of said support is supported by said at least one leg on said substrate and an interlock for intermittent connection of said expandable modular floor tile with at least one other modular floor tile; and a lock for the selective, slidable interconnection between said first and second floor tile subsections.

* * * * *